US008982036B2

(12) United States Patent
Kim et al.

(10) Patent No.: US 8,982,036 B2
(45) Date of Patent: Mar. 17, 2015

(54) LIQUID CRYSTAL DISPLAY AND LOCAL DIMMING CONTROL METHOD THEREOF CAPABLE OF REDUCING THE SIZE OF AN OPERATION ALGORITHM

(75) Inventors: Dongwoo Kim, Seoul (KR); Heewon Ahn, Gyeonggi-do (KR); Daeho Cho, Seoul (KR)

(73) Assignee: LG Display Co., Ltd., Seoul (KR)

( * ) Notice: Subject to any disclaimer, the term of this patent is extended or adjusted under 35 U.S.C. 154(b) by 743 days.

(21) Appl. No.: 12/788,051

(22) Filed: May 26, 2010

(65) Prior Publication Data

US 2011/0122057 A1 May 26, 2011

(30) Foreign Application Priority Data

Nov. 24, 2009 (KR) ..... 10-2009-0113943

(51) Int. Cl.
*G09G 3/36* (2006.01)
*G09G 3/34* (2006.01)

(52) U.S. Cl.
CPC ..... *G09G 3/3426* (2013.01); *G09G 3/3648* (2013.01); *G09G 2320/064* (2013.01); *G09G 2320/0646* (2013.01); *G09G 2360/16* (2013.01)
USPC ..... 345/102

(58) Field of Classification Search
USPC ..... 345/102; 349/61–70; 362/561
See application file for complete search history.

(56) References Cited

U.S. PATENT DOCUMENTS

2008/0252666 A1* 10/2008 Chen et al. ..... 345/690
2009/0267926 A1* 10/2009 Seo et al. ..... 345/204
2010/0156777 A1* 6/2010 Kang et al. ..... 345/102

FOREIGN PATENT DOCUMENTS

CN 101286300 10/2008

* cited by examiner

*Primary Examiner* — Ram Mistry
(74) *Attorney, Agent, or Firm* — McKenna Long & Aldridge LLP

(57) ABSTRACT

A liquid crystal display includes a liquid crystal display panel, a backlight unit including a plurality of light sources, a backlight driving circuit that individually drives a plurality of previously determined blocks each including the light sources based on a dimming value of each of the blocks, and a local dimming control circuit. The local dimming control circuit adjusts the dimming value of each block based on the result of an analysis of input data, calculates and interpolates sampling gain values of predetermined sampling positions positioned inside each block so as to compensate for a change amount of a luminance resulting from the dimming value of each block, obtains a gain value of each pixel, and modulate the input data to be applied to a corresponding pixel based on the gain value of each pixel.

8 Claims, 9 Drawing Sheets

FIG. 5

| | | | | | |
|---|---|---|---|---|---|
| BLK[1, 1] | BLK[1, 2] | BLK[1, 3] | BLK[1, 4] | · · · · | BLK[1, m] |
| BLK[2, 1] | | | | | |
| BLK[3, 1] | | | | | |
| ⋮ | | ⋮ | | · · · · | |
| BLK[n, 1] | | | | | BLK[n, m] |

LIQUID CRYSTAL DISPLAY AND LOCAL DIMMING CONTROL METHOD THEREOF CAPABLE OF REDUCING THE SIZE OF AN OPERATION ALGORITHM

This application claims the benefit of Korea Patent Application No. 10-2009-0113943 filed on Nov. 24, 2009, which is incorporated herein by reference for all purposes as if fully set forth herein.

BACKGROUND OF THE INVENTION

1. Field of the Invention

Embodiments of the invention relate to a liquid crystal display and a local dimming control method thereof capable of improving image quality.

2. Discussion of the Related Art

A range of application for liquid crystal displays has gradually widened because of its excellent characteristics such as light weight, thin profile, and low power consumption. The liquid crystal displays have been used in personal computers such as notebook PCs, office automation equipments, audio/video equipments, interior/outdoor advertising display devices, and the like. The liquid crystal displays display an image using a thin film transistor (TFT) as a switching element. A backlit liquid crystal display occupying most of the liquid crystal displays controls an electric field applied to a liquid crystal layer and modulates light coming from a backlight unit, thereby displaying an image.

The image quality of the liquid crystal display depends on its contrast characteristic. It is limited to improve the contrast characteristic using only a method for controlling a data voltage applied to the liquid crystal layer and modulating a light transmittance of the liquid crystal layer. As a solution thereto, a backlight dimming method has been proposed so as to improve the contrast characteristic. The backlight dimming method adjusts a luminance of a backlight unit depending on an image displayed on the liquid crystal display. The backlight dimming method includes a global dimming method for adjusting a luminance of the entire display surface of the liquid crystal display and a local dimming method for locally controlling a luminance of the display surface of the liquid crystal display. The global dimming method can improve a dynamic contrast ratio measured between two adjacent frames. The local dimming method can locally control the luminance of the display surface of the liquid crystal display within one frame period, thereby improving a static contrast ratio which is difficult to improve using the global dimming method.

As shown in FIG. 1, the local dimming method maps input data to a plurality of imaginary blocks BLK divided from a display surface of a liquid crystal display panel in a matrix form and obtains a representative value of the input data in each of the blocks BLK. The local dimming method adjusts a dimming value of each block BLK based on the representative value of each block BLK, thereby locally controlling a luminance of a backlight unit (i.e., light sources of the backlight unit). Further, the local dimming method multiplies the input data by a predetermined pixel gain value so as to compensate for a deficiency of the luminance of the backlight unit resulting from the adjustment of the dimming value of each block BLK, thereby compensating for the input data.

The pixel gain value is determined based on data required to allow a luminance obtained from a total amount of light (i.e., an amount of light in dimming) reaching a corresponding pixel in the local dimming using a dimming value of a block including the corresponding pixel to be equal to a luminance obtained from a total amount of light (i.e., an amount of light in non-dimming) reaching the corresponding pixel in non-local dimming. The pixel gain value is calculated by a ratio of the amount of light in the non-dimming to the amount of light in the dimming. The amount of light in the non-dimming indicates an amount of light reaching a corresponding pixel when all of the light sources are turned on at a maximum brightness and may be previously determined as a constant value for each pixel. As shown in FIG. 2, the amount of light in the dimming may be determined by a total amount of light reaching the corresponding pixel in an analysis area of size P×P surrounding a block including the corresponding pixel in the local dimming in a state where the block is positioned in the middle of the analysis area, where P indicates the number of blocks and is an odd number equal to or greater than 3.

However, as shown in FIG. 1, an operation for obtaining the pixel gain value has to be individually performed on all of the pixels and has to be performed in real-time. Therefore, the size of an algorithm of the operation for achieving the local dimming greatly increases.

SUMMARY OF THE INVENTION

Embodiments of the invention provide a liquid crystal display and a local dimming control method thereof capable of reducing the size of an operation algorithm for achieving local dimming.

In one aspect, there is a liquid crystal display comprising a liquid crystal display panel including a plurality of pixels, a backlight unit including a plurality of light sources, the backlight unit providing light to the liquid crystal display panel, a backlight driving circuit that individually drives a plurality of previously determined blocks each including the light sources based on a dimming value of each of the blocks, and a local dimming control circuit that adjusts the dimming value of each block based on the result of an analysis of input data, calculates and interpolates sampling gain values of predetermined sampling positions positioned inside each block so as to compensate for a change amount of a luminance resulting from the dimming value of each block, obtains a gain value of each pixel, and modulate the input data to be applied to each pixel based on the gain value of each pixel.

A number of sampling positions in each block are previously determined to be less than a number of pixels in each block.

The local dimming control circuit includes a dimming value adjusting unit that analyzes the input data of each block to obtain a representative value of each block and determines the dimming value of each block based on the representative value of each block, a light amount obtaining unit that obtains a first light amount indicating a total amount of light reaching the sampling positions when the dimming value of each block is applied, a gain value sampling unit that calculates a sampling gain value of each of the sampling positions using the first light amount and a second light amount indicating a total amount of light reaching the sampling positions when the dimming value of each block is not applied, a gain value interpolating unit that interpolates the sampling gain values to obtain a gain value of each pixel, and a data modulating unit that modulates the input data based on the gain value of each pixel.

The first light amount is a variable determined by a total amount of light reaching a corresponding sampling position in an analysis area of size P×P surrounding a block including the corresponding sampling position in a state where the block is positioned in the middle of the analysis area, where P indicates the number of blocks and is an odd number equal to or greater than 3. The second light amount is a constant previously determined by a total amount of light reaching the corresponding sampling position when all of the light sources of the backlight unit are turned on at a maximum brightness.

The gain value sampling unit divides the second light amount by the first light amount and performs an exponential operation of $1/\gamma$ on the division result, thereby obtaining the sampling gain value. The sampling gain value is calculated as a value for allowing a luminance before the dimming value of each block is applied to the corresponding sampling position to be equal to a luminance after the dimming value of each block is applied to the corresponding sampling position.

In another aspect, there is a local dimming control method of a liquid crystal display including a liquid crystal display panel including a plurality of pixels and a plurality of light sources providing light to the liquid crystal display panel, a plurality of previously determined blocks each including the light sources being individually driven, the local dimming control method comprising the steps of (A) adjusting a dimming value of each block for the light sources based on the result of an analysis of input data and (B) calculating and interpolating sampling gain values of predetermined sampling positions positioned inside each block so as to compensate for a change amount of a luminance resulting from the dimming value of each block, obtaining a gain value of each pixel, and modulating the input data to be applied to each pixel based on the gain value of each pixel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 5 illustrates an example of dividing a surface light source into blocks for achieving local dimming;

DETAILED DESCRIPTION OF THE EMBODIMENTS

Reference will now be made in detail embodiments of the invention examples of which are illustrated in the accompanying drawings.

Figure 1:
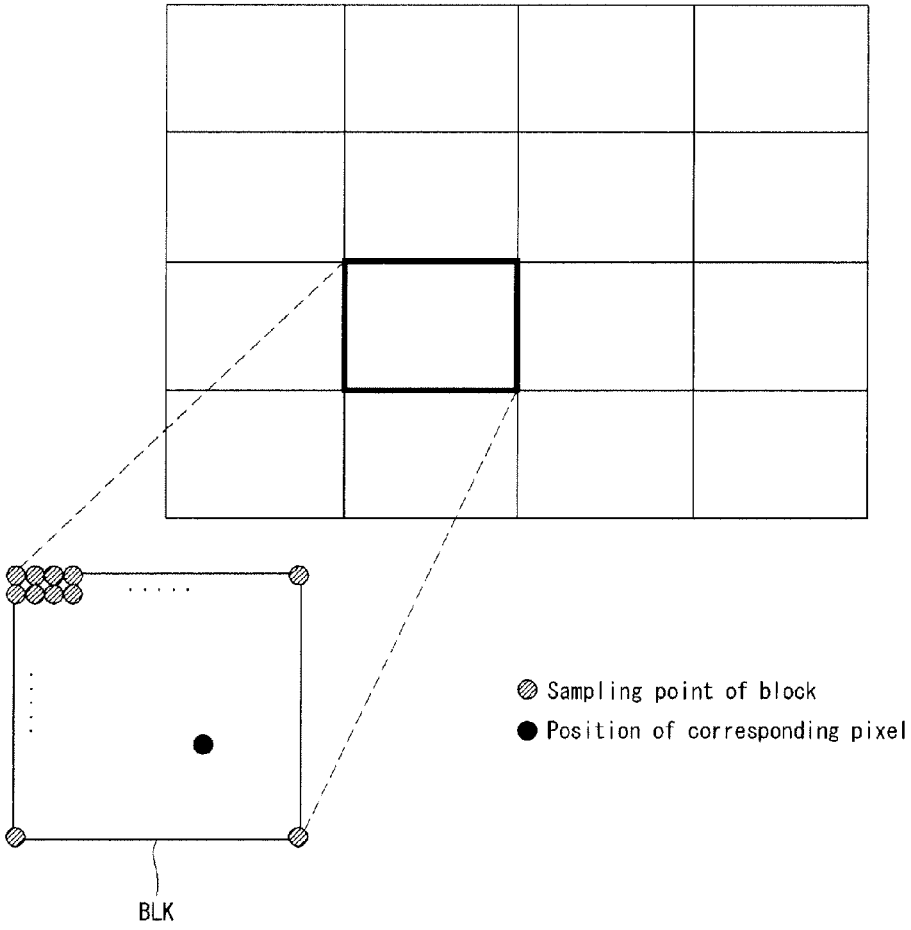
FIG. 1 (Related Art)
FIG. 1 illustrates a method for calculating a pixel gain value of each pixel in a related art.
Figure 2:
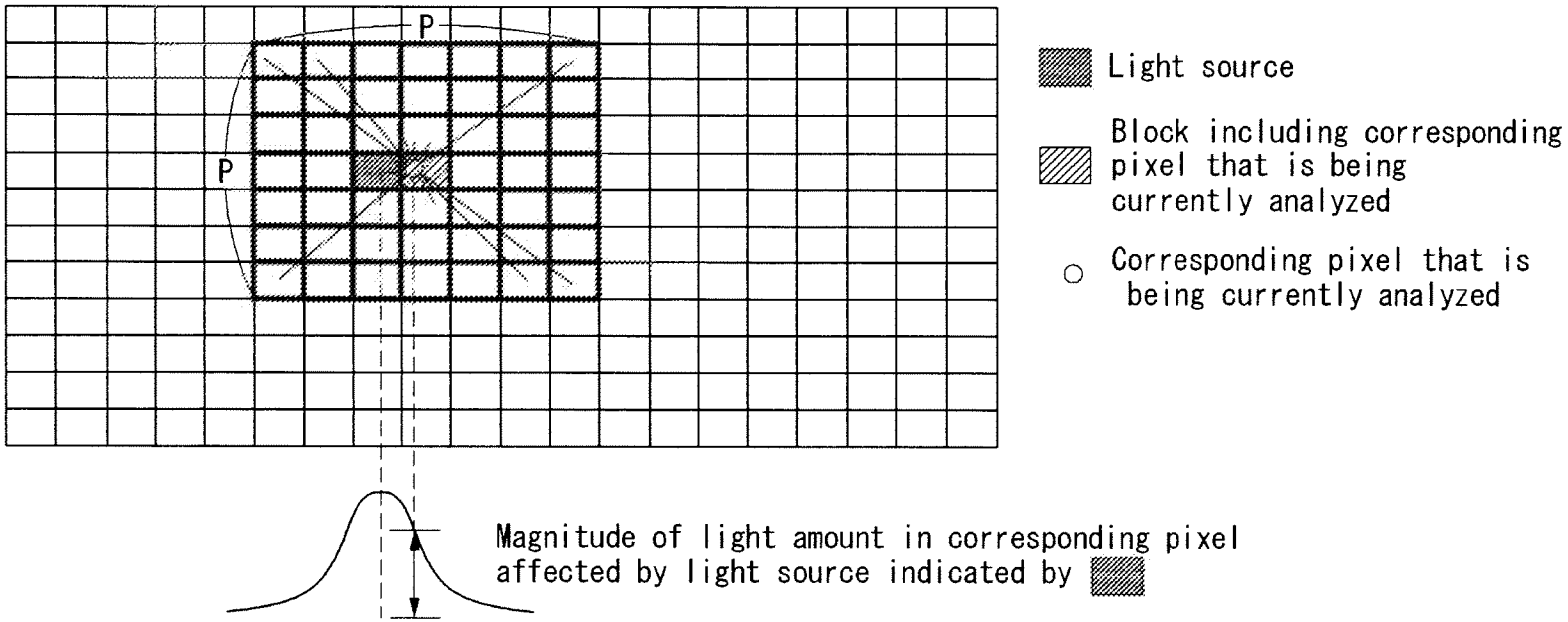
FIG. 2 (Related Art)
FIG. 2 illustrates an analysis area of size P×P surrounding a block including a corresponding pixel, where P is the number of blocks.
Figure 3:
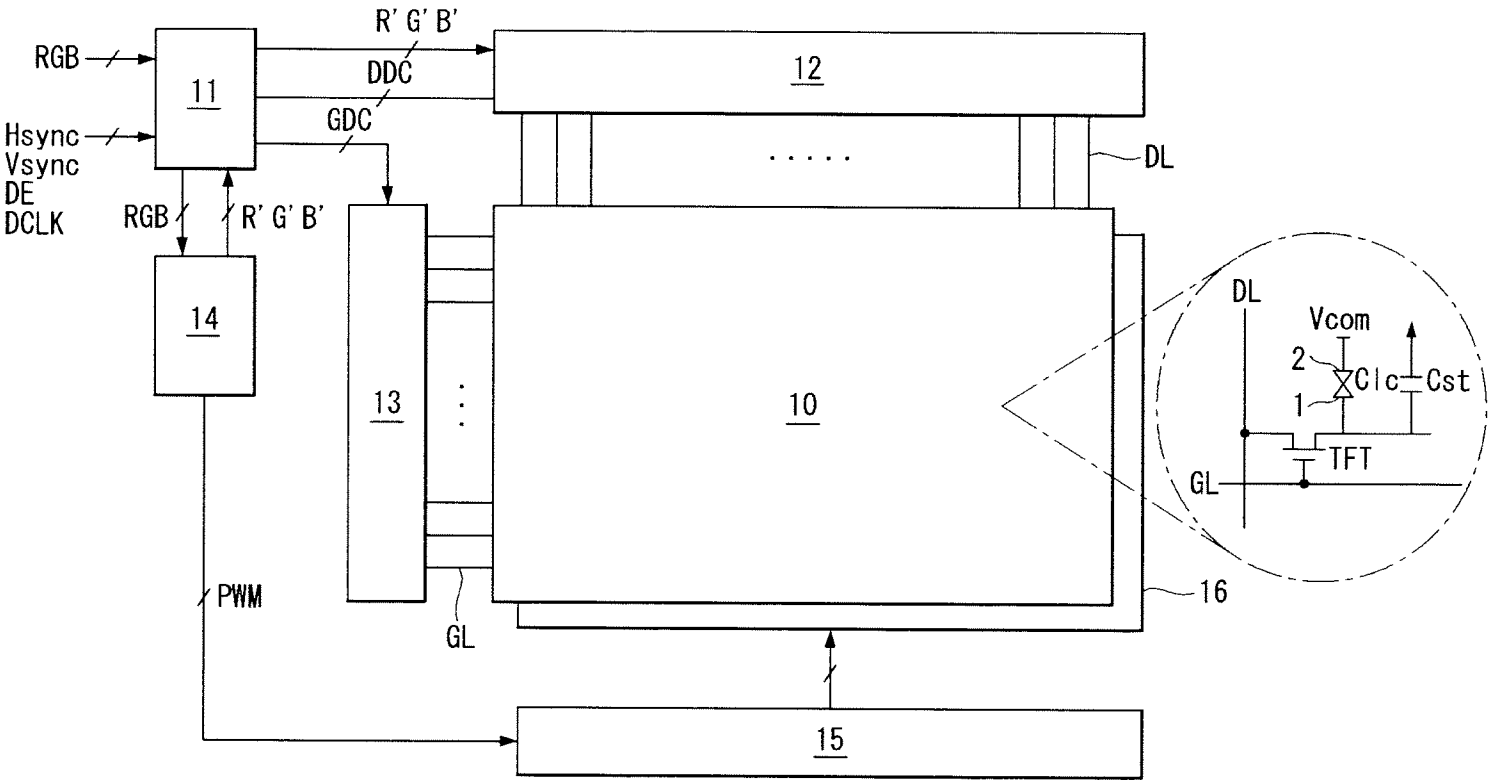
FIG. 3 illustrates a liquid crystal display according to an exemplary embodiment of the invention.

FIG. 3 illustrates a liquid crystal display according to an exemplary embodiment of the invention. As shown in FIG. 3, a liquid crystal display according to an exemplary embodiment of the invention includes a liquid crystal display panel 10, a timing controller 11, a data driving circuit 12, a gate driving circuit 13, a local dimming control circuit 14, a backlight driving circuit 15, and a backlight unit 16.

The liquid crystal display panel 10 includes an upper glass substrate, a lower glass substrate, and a liquid crystal layer between the upper and lower glass substrates. A plurality of data lines DL and a plurality of gate lines GL cross one another on the lower glass substrate of the liquid crystal display panel 10. A plurality of liquid crystal cells Clc are arranged on the liquid crystal display panel 10 in a matrix form in accordance with a crossing structure of the data lines DL and the gate lines GL. Each of the plurality of liquid crystal cells Clc includes a thin film transistor TFT, a pixel electrode 1 connected to the thin film transistor TFT, a storage capacitor Cst, and the like.

A black matrix, a color filter, and a common electrode 2 are formed on the upper glass substrate of the liquid crystal display panel 10. In a vertical electric field driving manner such as a twisted nematic (TN) mode and a vertical alignment (VA) mode, the common electrode 2 is formed on the upper glass substrate. In a horizontal electric field driving manner such as an in-plane switching (IPS) mode and a fringe field switching (FFS) mode, the common electrode 2 is formed on the lower glass substrate along with the pixel electrode 1. The plurality of liquid crystal cells Clc include red (R) liquid crystal cells for displaying a red image, green (G) liquid crystal cells for displaying a green image, and blue (B) liquid crystal cells for displaying a blue image. The R, G, and B liquid crystal cells form a unit pixel. Polarizing plates are respectively attached to the upper and lower glass substrates of the liquid crystal display panel 10. Alignment layers for setting a pre-tilt angle of liquid crystals are respectively formed on the inner surfaces contacting the liquid crystals in the upper and lower glass substrates.

The timing controller 11 supplies digital video data RGB received from a system board, on which an external video source is mounted, to the local dimming control circuit 14 and supplies a modulation data R'G'B' modulated by the local dimming control circuit 14 to the data driving circuit 12. The timing controller 11 receives timing signals Vsync, Hsync, DE, and DCLK from the system board to generate a data timing control signal DDC and a gate timing control signal GDC for respectively controlling operation timings of the data driving circuit 12 and the gate driving circuit 13 based on the timing signals Vsync, Hsync, DE, and DCLK. The timing controller 11 inserts an interpolation frame between frames of a signal of an input image input at a frame frequency of 60 Hz and multiplies the frequency of the data timing control signal DDC by the frequency of the gate timing control signal GDC. Hence, the timing controller 11 can control operations of the data driving unit 12 and the gate driving unit 13 at a frame frequency of (60×N) Hz, where N is a positive integer equal to or greater than 2.

The data driving circuit 12 includes a plurality of data driver integrated circuits (ICs). Each of the data driver ICs includes a shift register for sampling a clock, a register for temporarily storing the digital video data RGB, a latch that stores data corresponding to one line in response to the clock received from the shift register and simultaneously outputs the data each corresponding to one line, a digital-to-analog converter (DAC) for selecting positive and negative gamma voltages based on a gamma reference voltage corresponding to the digital data received from the latch, a multiplexer for selecting the data line DL receiving analog data converted from the positive and negative gamma voltages, an output buffer connected between the multiplexer and the data lines DL, and the like. The data driving circuit 12 latches the modulation data R'G'B' under the control of the timing controller 11 and converts the latched modulation data R'G'B' into positive and negative analog data voltages using positive and negative gamma compensation voltages. The data driving circuit 12 then supplies the positive and negative analog data voltages to the data lines DL.

The gate driving circuit 13 includes a plurality of gate driver ICs. Each of the gate driver ICs includes a shift register, a level shifter for converting an output signal of the shift register into a swing width suitable for a TFT drive of the liquid crystal cells, an output buffer, and the like. The gate driving circuit 13 sequentially outputs a gate pulse (or a scan pulse) under the control of the timing controller 11 and supplies the gate pulse to the gate lines GL. Hence, a horizontal line to receive the data voltage is selected.

The local dimming control circuit 14 analyzes the digital video data RGB received from the timing controller 11 in each of a plurality of imaginary blocks divided from a display surface of the liquid crystal display panel 10 in a matrix form to obtain a representative value of each of the blocks. The local dimming control circuit 14 adjusts a dimming value of each block of the backlight unit 16 based on the representative value of each block. The local dimming control circuit 14 calculates a sampling gain value in predetermined sampling positions inside each block, so as to compensate for a deficiency of a luminance of the backlight unit 16 resulting from the adjustment of the dimming value of each block using pixel data. The local dimming control circuit 14 interpolates the sampling gain value to determine a gain value of each pixel and then modulates the digital video data RGB to be applied to each pixel based on the determined pixel gain value.

The backlight driving circuit 15 drives a plurality of light sources of the backlight unit 16 based on a duty ratio of a pulse width modulation (PWM) signal received from the local dimming control circuit 14. In this case, the backlight driving circuit 15 individually drives the plurality of blocks each including the light sources. The duty ratio of the PWM signal is determined based on the dimming value of each block. Turn-on times and turn-off times of the light sources are controlled based on the duty ratio of the PWM signal.

The backlight unit 16 includes the plurality of light sources and divides a surface light source providing light to the liquid crystal display panel 10 into the plurality of blocks in a matrix form. The backlight unit 16 may be one of an edge type backlight unit and a direct type backlight unit. In the direct type backlight unit 16, a plurality of optical sheets and a diffusion plate are stacked under the liquid crystal display panel 10 and the plurality of light sources are positioned under the diffusion plate. In the edge type backlight unit 16, a plurality of optical sheets and a light guide plate are stacked under the liquid crystal display panel 10 and the plurality of light sources are positioned at the sides of the light guide plate. The plurality of light sources of the backlight unit 16 may be a point light source such as a light emitting diode (LED).

Figure 4:
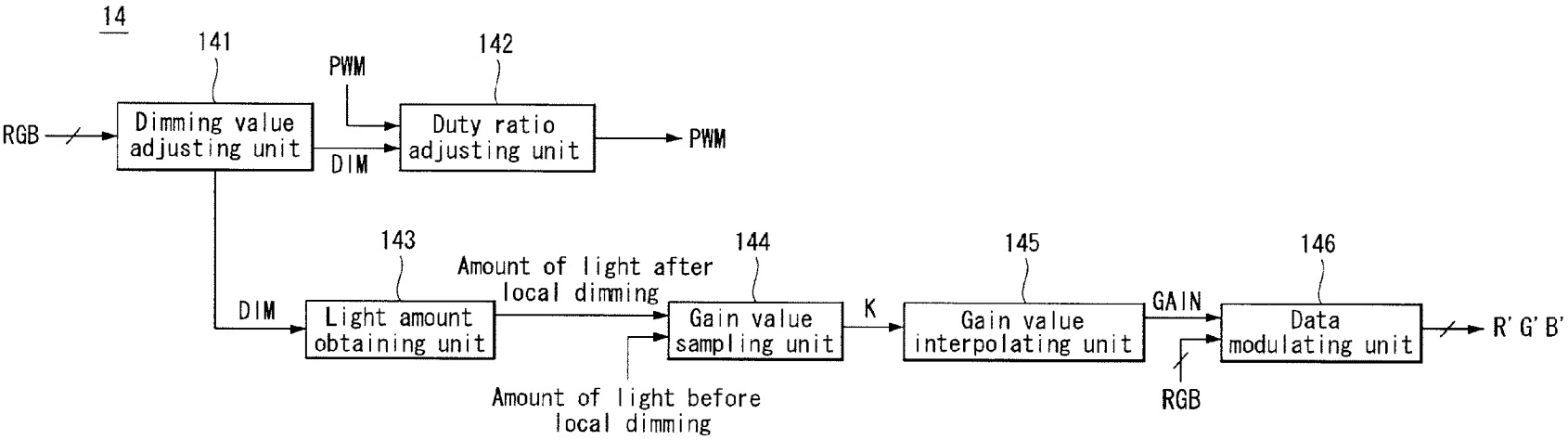
FIG. 4 illustrates an exemplary configuration of a local dimming control circuit.

FIG. 4 illustrates an exemplary configuration of the local dimming control circuit 14. As shown in FIG. 4, the local dimming control circuit 14 includes a dimming value adjusting unit 141, a duty ratio adjusting unit 142, a light amount obtaining unit 143, a gain value sampling unit 144, a gain value interpolating unit 145, and a data modulating unit 146.

As shown in FIG. 5, the dimming value adjusting unit 141 analyzes the digital video data RGB in each of a plurality of imaginary blocks BLK[1,1] to BLK[n,m] divided from the display surface of the liquid crystal display panel 10 in a matrix form to obtain a representative value of each of the blocks BLK[1,1] to BLK[n,m]. More specifically, the dimming value adjusting unit 141 obtains a maximum gray value from the digital video data RGB of each of pixels included in each block and divides a sum of maximum gray values of the pixels of each block by the number of pixels included in each block, thereby obtaining the representative value of each block. The dimming value adjusting unit 141 maps the representative value of each block to a previously determined dimming curve and adjusts a dimming value DIM of each block. The dimming value DIM of each block may be proportional to the representative value of each block.

The duty ratio adjusting unit 142 adjusts the duty ratio of the PWM signal for each block based on the dimming value DIM of each block received from the dimming value adjusting unit 141 and then supplies the PWM signal having the adjusted duty ratio to the backlight driving circuit 15. The duty ratio of the PWM signal of each block may be proportional to the dimming value DIM of each block. As the duty ratio of the PWM signal increases, a brightness of the light sources increases, and as the duty ratio of the PWM signal decreases, the brightness of the light sources decreases. The duty ratio adjusting unit 142 may be included in the backlight driving circuit 15.

Figure 6:
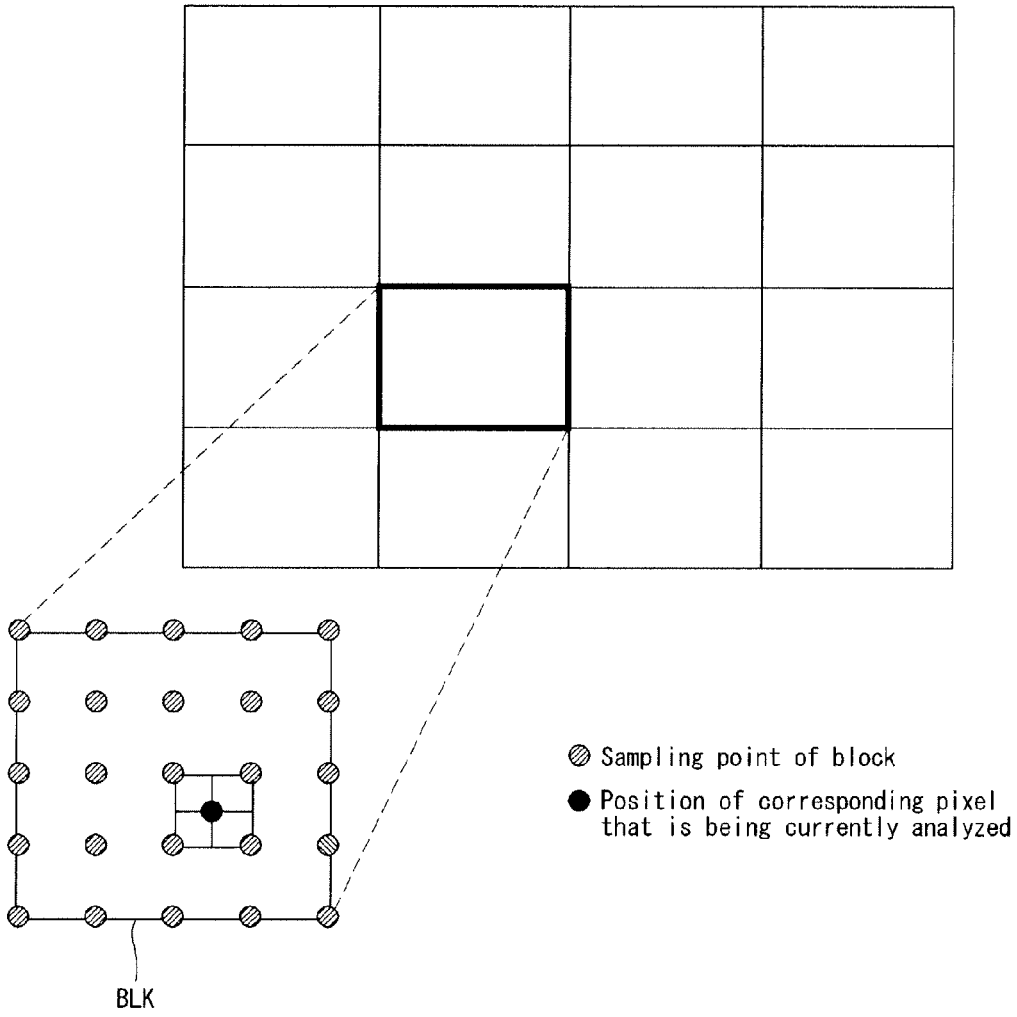
FIG. 6 illustrates a method for calculating a pixel gain value in sampling positions.

As shown in FIG. 6, the light amount obtaining unit 143 previously determines a plurality of sampling positions in each block, wherein the number of sampling positions in each block is less than the number of pixels in each block. The light amount obtaining unit 143 obtains an amount of light (i.e., an amount of light in dimming) reaching each sampling position in the local dimming using the dimming value DIM of each block. The amount of light in dimming in each sampling position is determined by a total amount of light reaching each sampling position. For example, the light amount obtaining unit 143 obtains a total amount of light reaching a corresponding sampling position in an analysis area of size P×P surrounding a block including the corresponding sampling position in the local dimming in a state where the block is positioned in the middle of the analysis area, where P indicates the number of blocks and is an odd number equal to or greater than 3. The amount of light in dimming is a variable depending on each of the dimming values DIM of the blocks positioned inside the analysis area. The light amount obtaining unit 143 may obtain the amount of light in dimming using an operation algorithm capable of being implemented by a lookup table. The sampling position may be determined by four apexes of an interpolation area having size 16×16 (corresponding to P being the number of pixels), so as to reduce the size of the operation algorithm without degrading the image quality of the liquid crystal display. The size of the interpolation area may vary as long as the image quality of the liquid crystal display is not degraded.

The gain value sampling unit 144 calculates a sampling gain value K of each sampling position using the amount of light in dimming received from the light amount obtaining unit 143 and an amount of light in non-local dimming (i.e., an amount of light in non-dimming). The amount of light in the non-dimming is a constant previously determined by a total amount of light reaching a corresponding sampling position when all of light sources of the backlight unit 16 are turned on at a maximum brightness. On the assumption that a luminance L in the non-local dimming is equal to a luminance L' in the local dimming as indicated in the following Equation 1, as indicated in the following Equation 2, the gain value sampling unit 144 divides an amount BL of light reaching the sampling position in the non-local dimming by an amount BL' of light reaching the sampling position in the local dimming. Then, the gain value sampling unit 144 performs an exponential operation of $1/\gamma$ on the division result, thereby obtaining the sampling gain value K for allowing a luminance before achieving the local dimming to be equal to a luminance after achieving the local dimming.

[Equation 1]

$$L=L' \quad (A)$$

$$BL\times(\text{Data}/\text{Data}_{max})^{\gamma}=BL'\times(\text{Data}'/\text{Data}_{max})^{\gamma} \quad (B)$$

[Equation 2]

$$\text{Data}'=\text{Data}\times(BL/BL')^{1/\gamma}=K\times\text{Data}$$

In the above Equations 1 and 2, "Data" indicates a data value of the digital video data RGB input to the pixel, "Data max" indicates a data value having a maximum gray level among "Data", and "Data'" indicates a data value of modulation data R'G'B'.

The gain value sampling unit 144 may perform the division operation and the exponential operation using the operation algorithm capable of being implemented by the lookup table. Because the gain value sampling unit 144 performs the operations only in the sampling positions, the size of the operation algorithm required in the gain value sampling unit 144 greatly decreases compared with a related art.

Figure 7A:
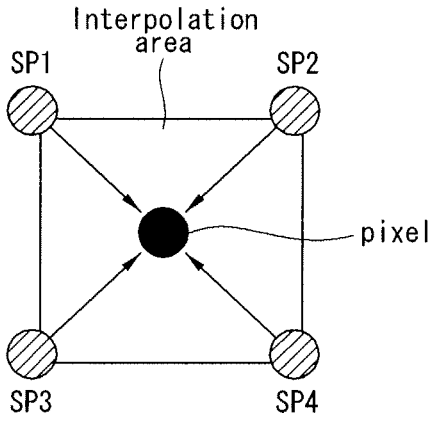
FIGS. 7A to 7C illustrate various examples of interpolation.
Figure 7B:
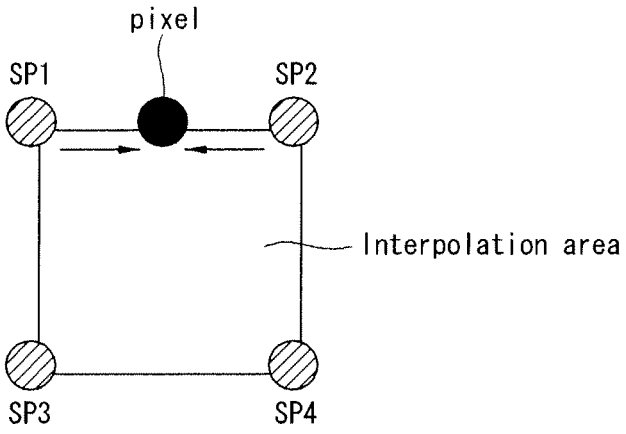
Figure 7C:
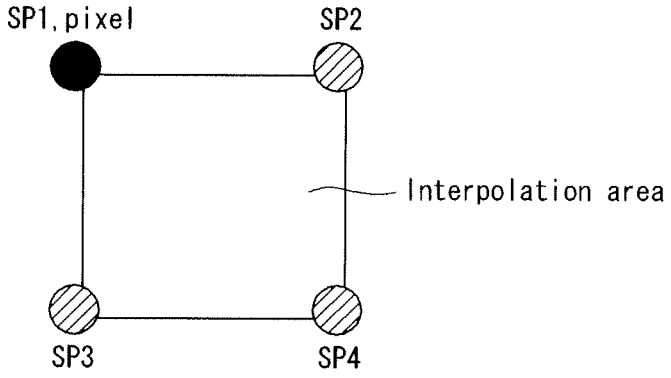

The gain value interpolating unit 145 interpolates the sampling gain values K of the sampling positions received from the gain value sampling unit 144 to obtain a gain value GAIN of the corresponding pixel. The gain value interpolating unit 145 may vary the number of interpolated sampling gain values K depending on where the corresponding pixel is positioned in an interpolation area defined by the sampling positions. For example, as shown in FIG. 7A, when a corresponding pixel is positioned inside four sides of an interpolation area defined by four sampling positions SP1 to SP4, the gain value interpolating unit 145 interpolates four sampling gain values K of the adjacent sampling positions SP1 to SP4 to obtain the gain value GAIN of the corresponding pixel. As shown in FIG. 7B, when the corresponding pixel is positioned on one side of the interpolation area, the gain value interpolating unit 145 interpolates two sampling gain values K of the adjacent sampling positions SP1 and SP2 to obtain the gain value GAIN of the corresponding pixel. As shown in FIG. 7C, when the corresponding pixel is positioned in one of the sampling positions SP1 to SP4, the gain value interpolating unit 145 interpolates a sampling gain value K of the sampling position SP1 to obtain the gain value GAIN of the corresponding pixel.

The data modulating unit 146 modulates the digital video data RGB to be applied to the pixel based on the gain value GAIN of the pixel received from the gain value interpolating unit 145 to produce modulation data R'G'B'. The data modulating unit 146 may increase an modulation width of data as the gain value GAIN of the pixel increases, and may decrease a modulation width of data as the gain value GAIN of the pixel decreases.

Figure 8:
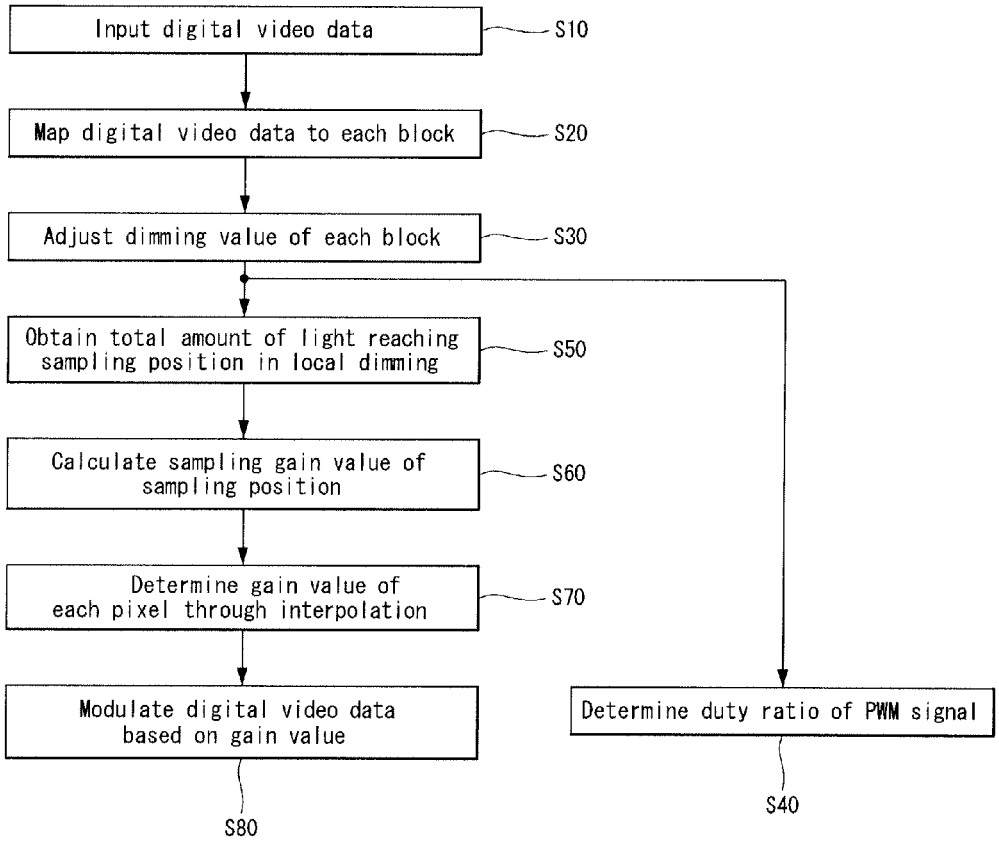
FIG. 8 illustrates a local dimming control method of a liquid crystal display according to an exemplary embodiment of the invention.

FIG. 8 illustrates a local dimming control method of a liquid crystal display according to an exemplary embodiment of the invention.

As shown in FIG. 8, the local dimming control method maps the input digital video data RGB to a plurality of imaginary blocks divided from the display surface of the liquid crystal display panel in a matrix form in steps S10 and S20. The local dimming control method obtains a representative value of each block and adjusts a dimming value of each block based on the representative value of each block in step S30.

The local dimming control method adjusts a duty ratio of an input PWM signal for each block based on the adjusted dimming value of each block and drives the light sources for each block in step S40.

The local dimming control method previously determines a plurality of sampling positions in each block, wherein the number of sampling positions in each block is less than the number of pixels in each block. The local dimming control method obtains an amount of light (i.e., an amount of light in dimming) reaching each sampling position in the local dimming using the adjusted dimming value of each block in step S50. The amount of light in dimming in each sampling position is determined by a total amount of light reaching a corresponding sampling position in an analysis area of size P×P surrounding a block including the corresponding sampling position in the local dimming in a state where the block is positioned in the middle of the analysis area, where P indicates the number of blocks and is an odd number equal to or greater than 3. The amount of light in dimming may be obtained using an operation algorithm capable of being implemented by the lookup table. The sampling position may be determined by four apexes of an interpolation area having size 16×16 (corresponding to P being the number of pixels), so as to reduce the size of the operation algorithm without degrading the image quality of the liquid crystal display. The size of the interpolation area may vary as long as the image quality of the liquid crystal display is not degraded.

The local dimming control method calculates a sampling gain value of each sampling position using the amount of light in dimming and an amount of light in non-local dimming (i.e., an amount of light in non-dimming) in step S60. The amount of light in the non-dimming may be previously determined by a total amount of light reaching the corresponding sampling position when all of the light sources are turned on at a maximum brightness. On the assumption that a luminance in the non-local dimming is equal to a luminance in the local dimming, the local dimming control method divides the amount of light reaching the sampling position in the non-local dimming by the amount of light reaching the sampling position in the local dimming. Then, the local dimming control method performs an exponential operation of 1/γ on the division result, thereby obtaining the sampling gain value for allowing a luminance before achieving the local dimming to be equal to a luminance after achieving the local dimming. The division operation and the exponential operation may be performed using the operation algorithm capable of being implemented by the lookup table. Because the local dimming control method performs the operations only in the sampling positions, the size of the operation algorithm required in the local dimming control method may greatly decrease compared with a related art.

The local dimming control method interpolates the sampling gain values of the sampling positions to obtain a gain value of the corresponding pixel in step S70. The local dimming control method modulates the digital video data RGB to be applied to the corresponding pixel based on the gain value of the corresponding pixel to produce the modulation data R'G'B' in step S80. The modulation data R'G'B' compensates for the deficiency of the luminance resulting from the dimming value of each block.

As described above, in the liquid crystal display and the local dimming control method thereof according to the embodiment of the invention, the gain value compensating for the luminance deficiency in the local dimming is calculated only in the sampling positions, wherein the number of sampling positions in each block is less than the number of pixels in each block. Therefore, the embodiment of the invention can greatly reduce the size of the operation algorithm, compared with a related art method for calculating a gain value of each pixel.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel including a plurality of pixels;

a backlight unit including a plurality of light sources, the backlight unit providing light to the liquid crystal display panel;

a backlight driving circuit that individually drives a plurality of previously determined blocks each including the light sources based on a dimming value of each of the blocks; and a local dimming control circuit that adjusts the dimming value of each block based on the result of an analysis of input data, previously determines a plurality of sampling positions in each block, wherein the number of sampling positions in each block is less than the number of pixels in each block, obtains an amount of light reaching each sampling position in the local dimming using the dimming value of each block, calculates sampling gain values of the sampling positions using only the amount of light reaching the sampling position in local dimming and an amount of light reaching the sampling position in non-local dimming where the amount of light in the non-local dimming is a constant previously determined by a total amount of light reaching the corresponding sampling position when all of the light sources of the backlight unit are turned on at a maximum brightness, interpolates the calculated sampling gain values of each block so as to compensate for a change amount of a luminance resulting from the dimming value of each block, obtains a gain value of each pixel, and modulates the input data to be applied to each pixel based on the gain value of each pixel.

2. The liquid crystal display of claim 1, wherein the local dimming control circuit includes:

a dimming value adjusting unit that analyzes the input data of each block to obtain a representative value of each block and determines the dimming value of each block based on the representative value of each block;

a light amount obtaining unit that obtains a first light amount indicating a total amount of light reaching the sampling positions when the dimming value of each block is applied;

a gain value sampling unit that calculates a sampling gain value of each of the sampling positions using the first light amount and a second light amount indicating a total amount of light reaching the sampling positions when the dimming value of each block is not applied;

a gain value interpolating unit that interpolates the sampling gain values to obtain a gain value of each pixel; and a data modulating unit that modulates the input data based on the gain value of each pixel.

3. The liquid crystal display of claim 2, wherein the first light amount is a variable determined by a total amount of light reaching a corresponding sampling position in an analysis area of size P×P surrounding a block including the corresponding sampling position in a state where the block is positioned in the middle of the analysis area, where P indicates the number of blocks and is an odd number equal to or greater than 3.

4. The liquid crystal display of claim 3, wherein the gain value sampling unit divides the second light amount by the first light amount and performs an exponential operation of $1/\gamma$ on the division result, thereby obtaining the sampling gain value, wherein the sampling gain value is calculated as a value for allowing a luminance before the dimming value of each block is applied to the corresponding sampling position to be equal to a luminance after the dimming value of each block is applied to the corresponding sampling position.

5. A local dimming control method of a liquid crystal display including a liquid crystal display panel including a plurality of pixels and a plurality of light sources providing light to the liquid crystal display panel, a plurality of previously determined blocks each including the light sources being individually driven, the local dimming control method comprising the steps of: (A) adjusting a dimming value of each block for the light sources based on the result of an analysis of input data; and (B) previously determining a plurality of sampling positions in each block, wherein the number of sampling positions in each block is less than the number of pixels in each block, obtaining an amount of light reaching each sampling position in the local dimming using the dimming value of each block, calculating sampling gain values of the sampling positions using only the amount of light reaching the sampling position in local dimming and an amount of light reaching the sampling position in non-local dimming where the amount of light in the non-local dimming is a constant previously determined by a total amount of light reaching the corresponding sampling position when all of the light sources are turned on at a maximum brightness, interpolating the calculated sampling gain values of each block so as to compensate for a change amount of a luminance resulting from the dimming value of each block, obtaining a gain value of each pixel, and modulating the input data to be applied to each pixel based on the gain value of each pixel.

6. The local dimming control method of claim 5, wherein the step (B) comprises:

previously determining a number of sampling positions in each block to be less than a number of pixels in each block and obtaining a first light amount indicating a total amount of light reaching the sampling positions when the dimming value of each block is applied;

calculating a sampling gain value of each of the sampling positions using the first light amount and a second light amount indicating a total amount of light reaching the sampling positions when the dimming value of each block is not applied;

interpolating the sampling gain values to obtain a gain value of each pixel; and modulating the input data based on the gain value of each pixel.

7. The local dimming control method of claim 6, wherein the first light amount is a variable determined by a total amount of light reaching a corresponding sampling position in an analysis area of size P×P surrounding a block including the corresponding sampling position in a state where the block is positioned in the middle of the analysis area, where P indicates the number of blocks and is an odd number equal to or greater than 3.

8. The local dimming control method of claim 7, wherein the calculating of the sampling gain value comprises dividing the second light amount by the first light amount and performing an exponential operation of $1/\gamma$ on the division result, wherein the sampling gain value is calculated as a value for allowing a luminance before the dimming value of each block is applied to the corresponding sampling position to be equal to a luminance after the dimming value of each block is applied to the corresponding sampling position.

* * * * *